United States Patent [19]

Freeman

[11] 4,385,706

[45] May 31, 1983

[54] CHILD RESISTANT CONTAINER AND CLOSURE

[75] Inventor: Bruce A. Freeman, Oklahoma City, Okla.

[73] Assignee: Carlisle Corporation, Oklahoma City, Okla.

[21] Appl. No.: 336,906

[22] Filed: Jan. 4, 1982

[51] Int. Cl.[3] ..... B65D 55/02

[52] U.S. Cl. ..... 215/225; 215/223

[58] Field of Search ..... 215/223, 224, 225, 321; 220/375, 339, 306

[56] References Cited

U.S. PATENT DOCUMENTS

| | | | |
|---|---|---|---|
| 3,469,725 | 9/1969 | Turner | 215/225 |
| 3,584,760 | 6/1971 | Grinker | 215/225 |
| 3,612,322 | 10/1971 | Linkletter | 215/225 |
| 3,667,637 | 6/1972 | Bagguhey et al. | 215/225 |
| 3,848,780 | 11/1974 | Stull | 215/223 |
| 3,863,797 | 2/1975 | Berghahn | 215/225 |
| 3,966,082 | 6/1976 | Hopkins | 220/306 |

*Primary Examiner*—George T. Hall

*Attorney, Agent, or Firm*—William R. Laney

[57] ABSTRACT

A container and closure assembly which is resistant to opening by a child, and which includes a container having a cylindrical neck portion having an annular safety ring key or key way therearound. A safety ring is rotatably mounted on the neck portion and is retained against axial movement thereon by the key or key way. The safety ring defines an access tab relief, and also an access tab safety recess adjacent the access tab relief. A closure cap which is dimensioned to fit over and close the opening at the upper end of the neck portion is hinged to the neck portion for pivotation between an open and closed position. The closure cap carries an access tab at a location spaced around the cap from the hinge by which the cap is connected to the neck portion.

11 Claims, 6 Drawing Figures

CHILD RESISTANT CONTAINER AND CLOSURE

FIELD OF THE INVENTION

This invention relates to child resistant safety closure devices which resist opening by children of tender years, thereby insuring against accidental poisonings of such children by the contents of the container.

BRIEF DESCRIPTION OF THE PRIOR ART

A great many safety closure devices have heretofore been developed and many of them have been patented. These safety closure devices undertake to prevent children from obtaining access to poisonous or deleterious contents of various types of containers on which the closures are mounted. Since the advent of government regulations which require the use of this type of closure for closing containers which contain many types of drugs and household chemicals, many types of safety closures have been developed and invented, and these operate on a variety of principles.

One general category of child resistant safety closures which has been heretofore developed and widely employed is a type which provides a protected thumb or finger tab carried on a cap which snaps over the upper end of a vial or container. In this category of closure, the protected thumb or finger tab is protected by a bead or ring which encircles the neck of the container, and is either fixed thereto or rotatable thereon.

The bead or ring carries a recess or relief which enables the underside of the finger tab to be accessible at a time when the tab is aligned with the recess or relief in the bead or ring. Alignment may be accomplished either by rotating the lid relative to the stationary bead, or rotating the bead or safety ring on the neck of the container until such alignment exists. At times when the relief is not aligned with the finger tab, the full thickness of the bead is beneath the tab and it is therefore not accessible for prying off the lid.

The following patents, constituting the closest prior art to the concept of the present invention which is presently known to me, show various types of protected finger or thumb tab-type safety closures.

Grinker U.S. Pat. No. 3,584,760 discloses a safety cap connected to a container by a hinge web so that it cannot be lost, and which is retained in its safety closure position by means of a rotatable ring carried around the neck of the container. The ring is rotatable about the axis of the container neck and relative to the snap cap safety lid itself. When the ring is rotated to a position in which a notch or recess formed in it has been aligned with a projecting access tab carried on the safety cap, the tab can then be pushed up to slip the safety cap off the container neck and thus open the container for dispensation of the contents. The Grinker structure also includes a spring element which continuously biases the safety ring toward its safe position—that is, a position where the recess formed in it is out of alignment with the thumb tab formed on the safety cap.

Hayes U.S. Pat. No. 3,145,872 also includes a hinged snap cap safety lid which snaps over the neck of a container, and is protected from access by means of a sleeve which is slotted or cut out at one location around its periphery in order to provide clearance for both the cap hinge and an opening tab formed on the cap and projecting from the outer periphery thereof.

In Grimm U.S. Pat. No. 3,393,816, a snap-on safety cap is provided which has a projecting finger or thumb tab. The neck of the container on which the cap is located has a radially outwardly flaring shoulder which extends under, and prevents access to, the removal tab of the cap except at such time as the tab is aligned with a relief formed in the shoulder at a peripheral location thereon.

A second Grimm et al. patent, U.S. Pat. No. 3,334,763 provides for a similar construction in which an integrally formed bead or shoulder on the container protects the thumb or finger access tab from the application of an opening force except at a time when the cap is properly aligned with a relief or recess in the shoulder.

A similar structure is illustrated in Thomas U.S. Pat. No. 3,071,271, and also in O'Donnell U.S. Pat. No. 3,170,585.

A bottle cap which snaps on the lid of a container and is retained in position by a linking strap which interconnects the cap with a ring encircling the neck of the container is shown in Linkletter et al. U.S. Pat. No. 3,407,956. Of similar import to a consideration of the present invention is Linkletter U.S. Pat. No. 3,612,322. Another Linkletter patent of interest to the general type of safety closure and container assembly under discussion is Linkletter U.S. Pat. No. 3,693,820. In this patent, a snap-on cap is provided for a container, and the container carries a rotary safety ring which prevents the cap from being removed from the container until the ring is disengaged from the cap. Here the safety ring is locked to the cap by a plurality of flexible fingers which prevent the ring from being disengaged from the cap unless the ring is first precisly aligned in a preselected position relative to the cap. The flexible fingers, however, allow the ring to be repositioned around the cap and locked thereto without first prepositioning the ring in any particular rotary position relative to the cap.

Harvath U.S. Pat. No. 3,627,160 similarly illustrates and describes a snap-on safety cap which has a radially projecting thumb or finger tab which can only be leveraged to remove the cap at a time when the finger tab is aligned with a slot formed in a locking rib which is molded integrally with, and around, the neck of the container.

Another patent of this general type is Hohl et al. U.S. Pat. No. 2,953,271.

Ryles U.S. Pat. No. 3,850,326 depicts a safety closure which includes a snap-on type lid which is hinged to one side of a plastic vial. The lid includes a pair of inwardly projecting circumferential flanges. The radially innermost of these frictionally engages a ridge formed around the inside of the mouth of the vial, and the radially outer flange projects into an upwardly opening groove or trough formed in the side wall of the vial at the upper edge thereof.

In the safety closures and associated containers which have been described as disclosed in the previously discussed patents, a common inadequacy of the structures there shown is the failure of the system to completely protect the thumb tab against the insertion of fingernails, the teeth of small children or other prying instrumentalities, even at such times as the bead or rib or safety ring carried on the container is out of the normal opening alignment which is thought to be required to permit the cap to be removed. With such limited access available, children can still, more frequently than desired, develop a sufficient prying action on the cap and tab to permit the closure cap to be removed, and the contents of the container to become accessible.

The present invention provides a child resistant container enclosure assembly which utilizes a safety ring which is rotatably mounted on the neck of the container, and which defines a protective cavity dimensioned to receive, and substantially entirely surround, a thumb or finger tab carried on a snap cap and lid which is used to close the container. The snap cap is joined to the container by a flexible hinge. The finger or thumb tab on the cap projects from the opposite side of the cap than that upon which the hinge is located, and is positioned to be aligned with a recess or relief provided in the peripheral portion of the safety ring at a location spaced on the ring from the tab receiving cavity. When the recess or relief in the safety ring is aligned with the tab, the tab can be lifted up with the finger or thumb to snap the cap off of the container and thereby provide access to the contents of the container.

An important object of the present invention is to provide a container and closure assembly which is more resistant to opening by small children than containers and closures of this type previously made, and which achieves the enhanced resistance to opening by children in a way which does not make the container more difficult to open for older persons, or for persons with physical infirmities which prevent them from exerting above average, or even average, physical strength in the course of opening the container.

A further object of the invention is to provide a three-part safety closure assembly which is simply, yet sturdily constructed, and which can be easily understood by adults and used by them to obtain access to the contents of the container, but which present a baffling problem to children of tender years trying to open the container.

Additional objects and advantages of the invention will become apparent as the following detailed description of a preferred embodiment of the invention is read in conjunction with the accompanying drawings which illustrate the invention.

GENERAL DESCRIPTION OF THE DRAWINGS

FIG. 6 is a sectional view taken along line 6—6 of FIG. 3.

DETAILED DESCRIPTION OF A PREFERRED EMBODIMENT OF THE INVENTION

Figure 1:
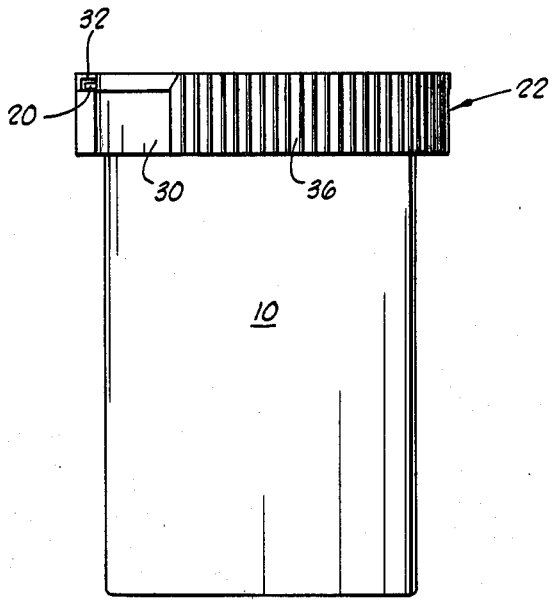
FIG. 1 is a side elevation view of the container and child resistant container closure assembly of the invention.
Figure 4:
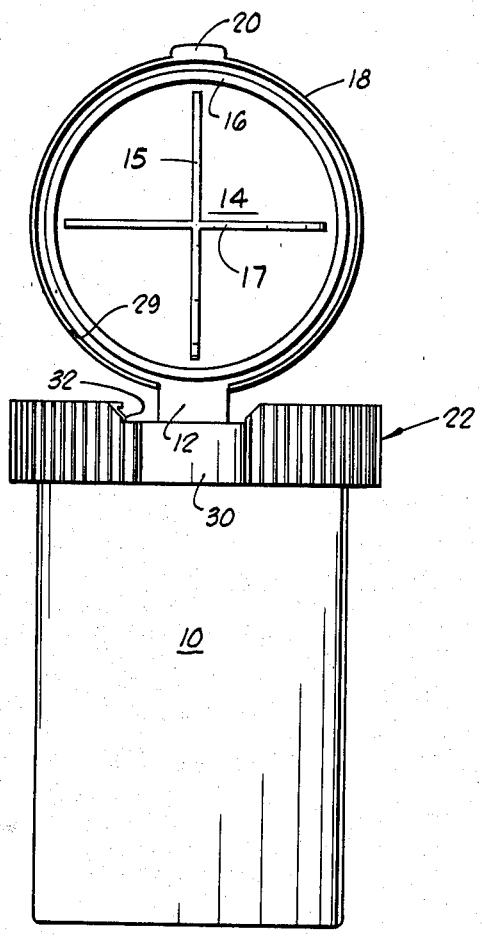
FIG. 4 is a front elevation view of the container and closure assembly with the snap cap lid in its open position.

Referring initially to FIGS. 1 and 4 of the drawings, the child resistant container and closure assembly of the invention includes a container 10 which, in the illustrated embodiment of the invention, is a plastic vial of cylindrical configuration. Connected to the vial 10 by a hinge 12 which joins the vial at a location near its open upper end is a snap cap lid 14. The lid 14 is provided with reinforcing ribs 15 and 17 arranged in cruciform configuration on the inner face of the lid as shown in FIGS. 4 and 6. The lid 14 is dimensioned to close the open upper end of the container 10 and is provided with an annular radially inner flange 16 and an annular radially outer flange 18. When the lid 14 is closed as shown in FIG. 6, the flange 16 is in frictional engagement with a beveled rib 19 carried on the radially inner side of the container 10 near its open upper end. The flange 16 defines an annular groove of generally V-shaped cross-section at a location to mate with and sealingly engage the beveled rib 19 when the lid 14 is fully closed as shown in FIG. 6.

Carried on the radially outer flange 18, and projecting radially outwardly therefrom is a thumb or finger tab 20. It will be noted that the thumb or finger tab 20 is disposed on the opposite side of the lid from the hinge 12. When the lid 14 is pivoted to an open position on the container 10, it appears as shown in FIG. 4.

For the purpose of retaining the lid 14 in a closed position, and in a status where it is very difficult for small children to open the lid so as to obtain access to the contents of the container, a safety ring 22 is rotatably mounted on, and surrounds the neck of the container at a location immediately adjacent the cap 14. The safety ring 22 is retained against axial movement on the container 10 by a protuberant annular rib 24 around the container which projects into a mating annular groove 26 formed on the inner side of the safety ring 22. A pair of arcuate ribs 27 disposed on opposite sides of the container adjacent its open mouth are also provided and function as stops against which the outer flange 18 of the lid bears when the lid is closed. Adjacent its upper edge, the safety ring 22 defines a groove or relief 28 at its radially inner side which receives the ribs 27 and the radially outer flange 18 of the lid 14 when the lid is snapped to a closed position as shown in FIG. 6 of the drawings.

Figure 2:
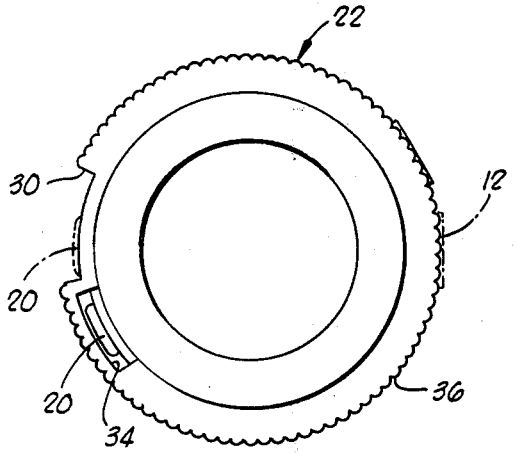
FIG. 2 is a bottom plan view of the child resistant container and closure assembly.
Figure 5:
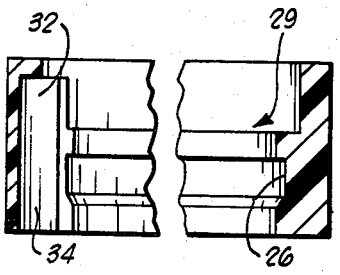
FIG. 5 is a sectional view taken along line 5—5 of FIG. 3.
Figure 5:
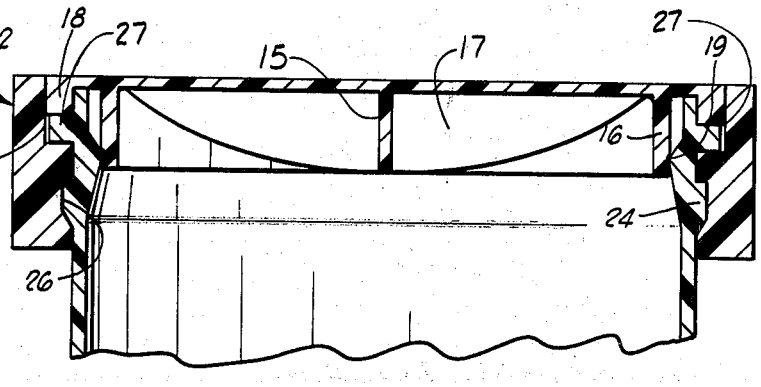

It will be noted in referring to FIG. 2 that the safety ring 22 is relieved over a portion of its periphery to provide a first relief 30 illustrated in FIG. 2 of the drawings. The safety ring is chamfered or beveled at the opposite ends of the relief 30 as shown in FIGS. 2 and 4. A similar second relief 31 terminating at its opposite ends in chamfers is provided on the opposite side of the ring. A small detent 33 protrudes upwardly from the ring 22 at about the center of the relief 31 for a purpose hereinafter described. The ring 22 further defines a cavity 32 formed therein and dimensioned to accommodate and receive the tab 20 within the cavity, thus protecting the tab from any access from above or below when the tab is located in the cavity. For injection molding purposes, an opening 34 is provided from the lower side of the ring 22 upwardly into the cavity 32, as best illustrated in FIGS. 2 and 5. At its outer side, the safety ring 22 is provided with knurling or a plurality of serrations 36 to facilitate gripping the ring 22 in order to rotate it around the neck of the container.

In the use and operation of the child resistant container and closure assembly of the invention, the container 10 is filled by opening the lid 14 to the position shown in FIG. 4. The lid 14 is retained in this upwardly opened position by the hinge 12 which is connected to the upper side of the container 10. At this time, the safety ring 22 is aligned with respect to the hinge 12 and the tab 20 in the relationship of alignment illustrated in FIG. 4.

After the container 10 has been filled, the lid 14 is pivoted on the hinge 12 until the radially outer peripheral flange 18 snaps over the upper edge of the container, and the radially inner flange 16 snaps inside of the open upper end of the container in the manner depicted in FIG. 6.

Figure 3:
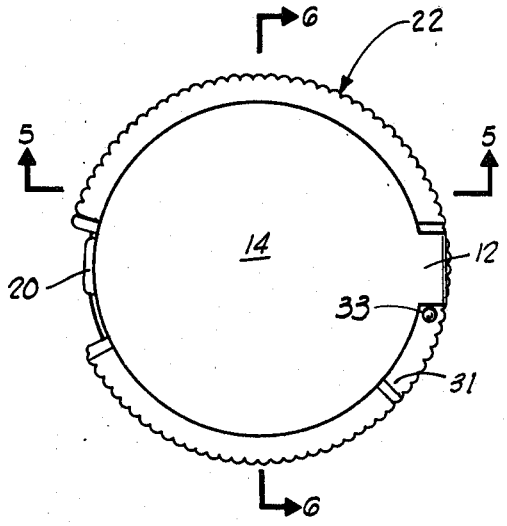
FIG. 3 is a top plan view of the child resistant container and closure assembly.

When the lid 14 is first snapped to its closed position the tab 20 is in alignment with the relief 30 formed in the safety ring 22, and the tab is thus at this time accessible from beneath so that a finger or the thumb can be used to snap the lid 14 upwardly to its open position. In order to make the assembly safe against access to the contents by children, the safety ring 22 is rotated about the neck of the container in a counterclockwise direction as illustrated in FIG. 3. The ring 22 can be rotated in this direction by reason of the ability of the hinge 12 to move within the large relief or slot 31 formed in the opposite side of the ring from the relief 30. As the safety ring is moved in a counterclockwise direction as viewed in FIG. 3, the thumb or finger tab 20 is caused to pass into the cavity 30 where it assumes the position as shown in full lines in the bottom plan view depicted in FIG. 2. The position of the hinge 12 and the tab 20, prior to rotating the ring to place the closure in a safe status, are illustrated in dashed lines in FIG. 2. It will be perceived that when the ring 22 is rotated to the safe position, no access can be had to the tab 20 from below due to the enclosure of the tab within the cavity 32 at this time. It will also be noted that in being rotated to the safe position, the hinge 12 rides up over and crosses the detent 33 so that the detent is on the opposite side of the hinge 12 from its position illustrated in FIG. 3.

When an authorized user of the contents of the container desires access thereto, the safety ring 22 is rotated in a clockwise direction, as illustrated in FIG. 3, until the tab 20 emerges from the cavity 32 and assumes the position shown in full lines in FIG. 3. At this time, the thumb or finger can be placed under the tab and pressed upwardly against the tab to snap the lid 14 off of the container and thereby open it.

When a child attempts to open the container, even if the initial motion of rotating the safety ring has been discerned as the proper action, the detent 33 opposes rotation of the ring with a frictional force difficult for a small child to overcome.

Although a preferred embodiment of the invention has been herein described, it will be understood that various changes and innovations can be effected in the illustrated and described structure without change in the basic principles which underlie the invention. Changes and innovations of this type are therefore deemed to be circumscribed by the spirit and scope of the invention, except as the same may be necessarily limited by the appended claims, or reasonable equivalents thereof.

What is claimed is:

1. A child resistant container and closure assembly comprising:

a container having an open-ended cylindrical neck portion;

retainer means around the neck portion for engaging a safety ring rotatably mounted on the neck portion to prevent axial movement of the safety ring on the neck portion;

a safety ring rotatably mounted on said neck portion and engaged with said retainer means, said safety ring having a tab exposure relief therein, and defining a tab safety recess circumferentially spaced from said tab exposure relief;

a lid adapted to cover and close the opening to said neck portion;

a hinge structure connecting the lid to said neck portion; and an access tab projecting from said lid on the opposite side thereof from said hinge, said access tab having a dimension and location such that when said lid is closed, said tab is protected by said safety ring from lifting with a finger except when said ring is rotated to a position to align said access tab with said tab exposure relief.

2. A child resistant container and closure assembly as defined in claim 1 wherein said retainer means comprises at least one protuberant rib projecting from the neck portion of the container and slidably engaging said safety ring.

3. A child resistant container and closure assembly as defined in claim 1 wherein said lid, hinge structure and container are integrally molded from a synthetic resin material.

4. A child resistant container and closure assembly as defined in claim 1 wherein said tab safety recess has an opening thereinto adjacent said tab exposure relief for facilitating movement into said safety recess when said safety ring is rotated.

5. A child resistant container and closure assembly as defined in claim 1 wherein said safety ring is further characterized as including a hinge structure relief on the side thereof opposite said tab exposure relief for accommodating said hinge structure.

6. A child resistant container and closure assembly as defined in claim 1 wherein said tab safety recess and said tab are dimensioned so that said tab safety recess encloses said tab when said safety ring is rotated to place said tab in said safety recess.

7. A child resistant container and closure assembly as defined in claim 1 wherein said assembly is further characterized as including:

a beveled rib carried on the radially inner side of said container neck portion; and an annular flange carried on said lid and projecting into said container neck into frictional engagement with said rib when said lid is closed on said container.

8. A child resistant container and closure assembly as defined in claim 6 wherein said lid, hinge structure and container are integrally molded from a synthetic resin material.

9. A child resistant container and closure assembly as defined in claim 8 wherein said safety ring is further characterized as including a hinge structure relief on the side thereof opposite said tab exposure relief for accommodating said hinge structure.

10. A child resistant container and closure assembly as defined in claim 9 wherein said retainer means comprises at least one protuberant rib projecting from the neck portion of the container and slidably engaging said safety ring.

11. A child resistant container and closure assembly comprising:

a container having an open-ended cylindrical neck portion;

a plastic lid snap engageable with said neck portion to close the open end thereof, said lid having a tab projecting therefrom; and a safety ring on the neck of the container and including a tab-protective cavity formed therein, said cavity having an opening on one side thereof dimensioned to allow passage of the tab therethrough into the cavity, said ring and lid being movable relative to each other and about the axis of said cylindrical neck portion to locate said tab in said cavity, or move said tab outside said cavity in an exposed position.

* * * * *